United States Patent [19]

Muller et al.

[11] 4,140,242

[45] Feb. 20, 1979

[54] NEWSPAPER AND PERIODICAL SINGLE-COPY VENDING MACHINE

[76] Inventors: Robert F. Muller, 23 Mountain Ave., Wayne, N.J. 07470; Albert J. Dennerlein, 45 Kuiken Ct., North Haledon, N.J. 07508

[21] Appl. No.: 816,043

[22] Filed: Jul. 15, 1977

[51] Int. Cl.[2] ..... A47F 1/04

[52] U.S. Cl. ..... 221/154; 221/155; 221/241

[58] Field of Search ..... 221/154, 155, 227, 241, 221/242, 251, 279; 194/2

[56] References Cited

U.S. PATENT DOCUMENTS 3,905,530 9/1975 Emmel ..... 221/155

4,067,477 1/1978 Chalabian ..... 221/155 X

*Primary Examiner*—Stanley H. Tollberg

*Attorney, Agent, or Firm*—James J. Cannon, Jr.; James J. Cannon

[57] ABSTRACT

A single-copy, coin operated, newspaper and periodical vending machine, specifically including a mechanism for regulating the size of the dispensing opening according to the thickness of the newspaper or periodical being dispensed, said mechanism being manually adjustable when the dispensing machine is loaded, further including a self-compensating spring-loaded mechanism for feeding a stack of newspapers or periodicals to the dispensing opening, and a display panel to permit viewing of the newspaper or periodical dispensed from the machine.

4 Claims, 7 Drawing Figures

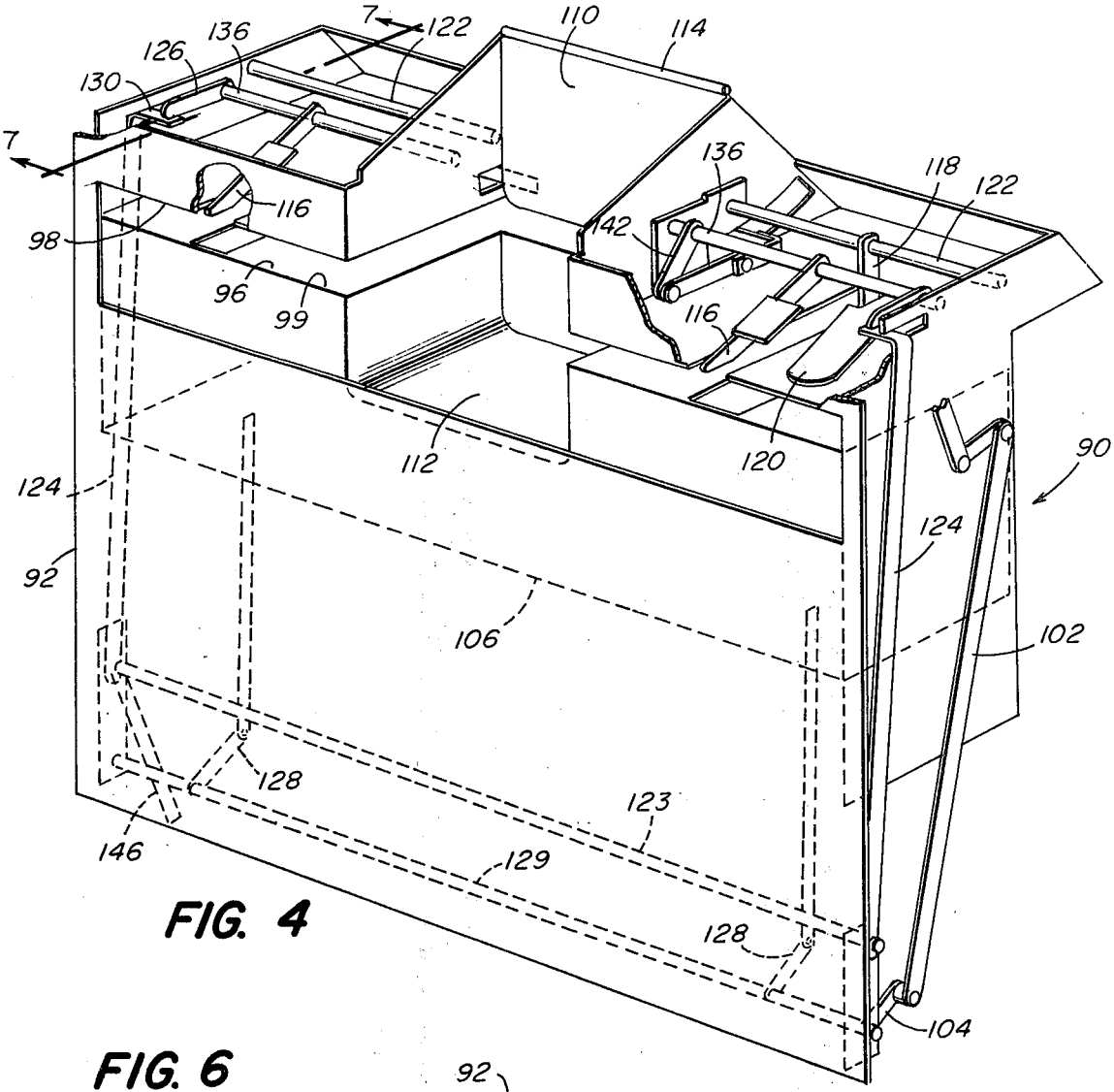
FIG. 4
FIG. 6
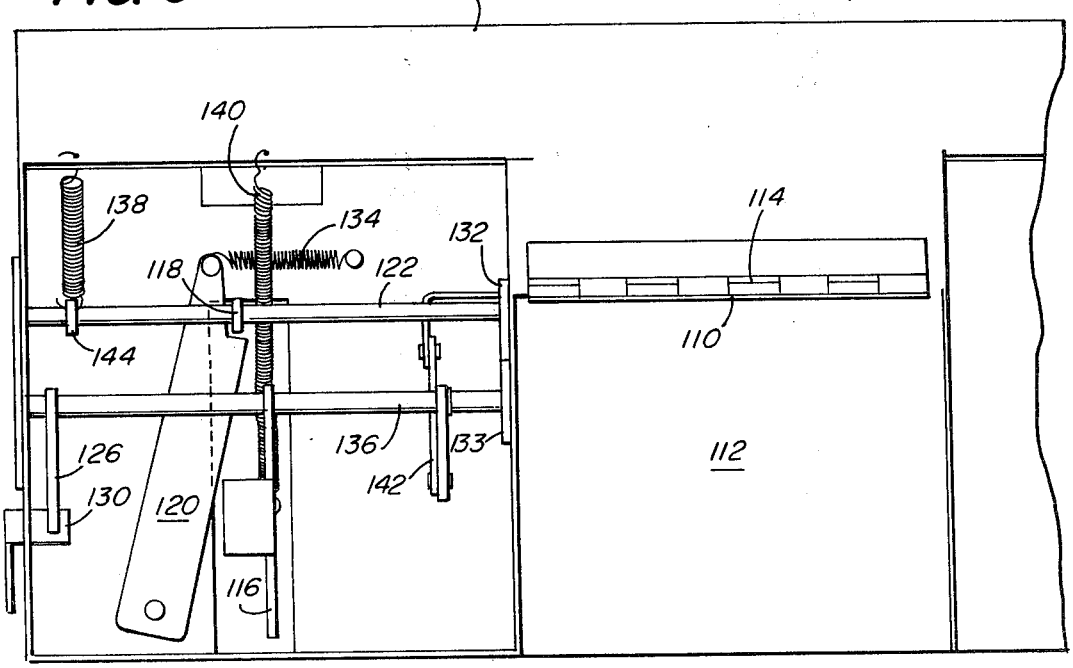

NEWSPAPER AND PERIODICAL SINGLE-COPY VENDING MACHINE

BACKGROUND OF THE INVENTION

1. Field of the Invention

This invention pertains to a coin-operated single-copy dispensing machine for newspapers, periodicals and similar articles in which a stack of said articles is depleted in the order in which they are stacked; there is a transparent inspecting means to determine the articles being dispensed; there are interrelated actuators to activate the mechanism on deposit of the correct combination of coins and to deactivate it upon the withdrawal of a single article; having adjusting means for adaptation to the size of articles being dispensed; and a self-compensating means for adjusting to a decreasing supply.

2. Description of the Prior Art

This invention pertains primarily to coin-operated, single-copy newspaper dispensing machines, though it should be understood that the basic invention also may be utilized for dispensing periodicals or other articles of relatively similar shape. For purposes of this discussion, the prior art will be divided into two categories, commercially available newspaper dispensing machines and patented, non-commercially available newspaper dispensing machines.

The problems associated with newspaper vending and dispensing machines are well documented in the prior art. These include weather-proof cabinets, secure coin boxes, means to display the article being vended, ease of loading the machine and single-copy dispensing. Both commercially available machines and patented, non-commercially available machines have solved the bulk of these problems. However, despite claims to the contrary, the problem of a secure, effective single copy dispensing machine which is economically feasible for a low-margin distribution system has remained unsolved. The device of the present invention is directed to a solution of this problem.

Commercially available newspaper vending machines currently suffer a loss rate of twelve to sixteen percent; that is, one of every six to eight newspapers is removed from the machine without payment. This loss rate is too great for a distributor to bear, since it is a loss of gross revenue. The dispensing mechanism of the present invention is designed precisely to solve this problem. It provides a newspaper withdrawal opening which is adjustable to the thickness of a single newspaper. As the newspaper is withdrawn through the dispenser opening, a pair of spring-operated levers snap into position to block the withdrawal of another paper until the door is closed and payment is made.

In the prior patent art, only U.S. Pat. No. 3,747,733, issued to Knickerbocker, discloses a design for a relatively secure, single copy newspaper dispensing machine. The design disclosed in this patent is unduly complex. For example, it includes a paper display compartment which is a locked compartment containing a single copy of the paper being dispensed. After the last paper in the machine has been dispensed, this compartment is unlocked so that the display copy may be sold. The present invention avoids the additional parts necessary for this complex mechanism by providing a simple means for viewing the top of the stack of papers in the machine. The elevator mechanism of Knickerbocker to bring the stack of papers to the dispenser mechanism is unnecessarily complex, requiring a winch to control tension, and is simplified in the present invention by a spring loaded device. The paper thickness adjustment mechanism of the Knickerbocker patent is also unduly complex and has been extremely simplified in the present invention. The paper withdrawal control means of this application is also greatly simplified. In the machine of the present invention, the result of simplification of the component subsystems results in a substantial reduction in the number of parts, a substantial reduction in the manufacturing cost and a substantial increase in reliability.

SUMMARY OF THE INVENTION

The present invention relates to a coin-operated newspaper single-copy dispensing machine that is designed primarily for the single-copy dispensing of newspapers and/or periodicals. The single copy of a newspaper is ready for dispensing or removal from the machine after the proper combination of coins have been inserted into the machine's coin release mechanism.

The present invention has been designed with the primary object of assuring the customer's access to only one newspaper upon the insertion of the proper combination of coins, and opening the customer access door, thereby eliminating the costly problem of newspapers being extracted from the unattended dispenser without proper payment.

A further object of the present invention has been to design a single-copy newspaper dispensing device incorporating a suitable storage cabinet, that will be manufactured, sold, and serviced at an economically competitive cost.

The present invention incorporates a coin-actuated release mechanism situated to the right of the customer access door and attached to the machine housing proper. This feature allows ready access to this coin mechanism in the event of a need for servicing.

The present invention comprises a weather-proof metal cabinet of sufficient size to allow the storage of a supply of newspapers or periodicals to be dispensed.

The present invention allows ready access for attendant-loading of newspapers, through a top-loading panel, which is controlled by a key-lock mechanism incorporated therein for security purposes.

In the present invention the newspapers or periodicals being dispensed are stacked in a horizontal position and are being continually fed to the single-copy withdrawal gate of the dispensing means by an upwardly directed spring-controlled force that acts upon the newspaper supply platform. This extremely simplified self-compensating newspaper supply system is trouble-free and eliminates the need for complicated drive mechanisms in the design of the machine.

This invention allows for the observation by the customer of the front page of the newspaper on the top of the stack within the machine. This is accomplished through the means of a transparent viewing window in the top loading panel. When the last newspaper is sold from the machine a "sold out" sign on top of the newspaper supply platform is visible through the transparent viewing window in the top loading panel. The present invention's observation system mentioned above is further augmented by the presence of a mirror mounted to the rear panel of the customer viewing housing. This mirror allows a potential customer to view the front page of the newspaper within the machine from a greater distance.

This invention further incorporates a copy thickness adjusting means which provides for the manual correct setting of the adjustable opening of the single-copy withdrawal gate. This withdrawal gate opening adjustment is accomplished by the attendant when he places a supply of newspapers or periodicals within the storage cabinet. It also includes a means whereby only one copy can be removed by the customer after the customer access door has been opened.

The copy thickness adjustment means and the single-copy dispensing means are both related and incorporated into the single-copy dispensing mechanism of the present machine, which is located between the customer access door and the stack of newspapers. The dispensing mechanism includes a vertically oriented housing having a horizontally oriented, adjustable withdrawal gate opening, large enough to permit the customer withdrawal of a newspaper. Adjustment of this opening is accomplished by an arcuate movement of a lever which raises or lowers the base of the paper delivery opening of the dispensing mechanism. The dispensing mechanism further includes an opening in which the customer may insert a hand to grasp a newspaper after payment and the opening of the customer access door. The single-copy mechanism of this invention is so designed to allow customer access to only one copy. After this copy is pulled through the withdrawal gate of the dispensing means, a set of levers drop into the path of the withdrawal gate, thereby blocking further paper removals until the customer access door is closed, and a further insertion of coins in made, with the access door being reopened.

BRIEF DESCRIPTION OF THE DRAWINGS

FIG. 4 is a cut-away perspective view of the single-copy dispensing mechanism removed from the machine of FIG. 1.

FIG. 6 is a top perspective view of the single-copy dispensing mechanism of the present invention.

DESCRIPTION OF THE PREFERRED EMBODIMENT

Figure 1:
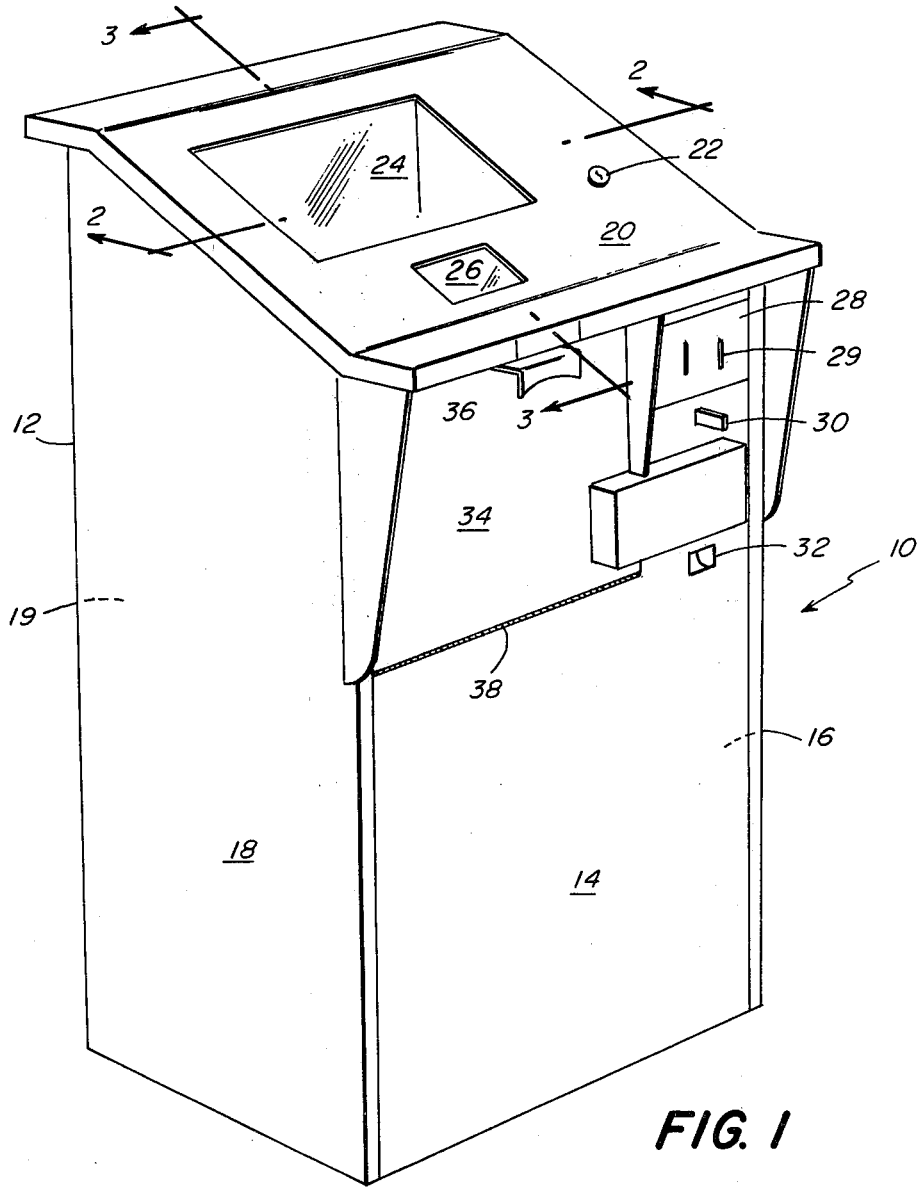
FIG. 1 is a front perspective view of the newspaper dispensing machine of the present invention.

FIG. 1 is a front perspective view of the newspaper and periodical single-copy vending machine of the present invention. The newspaper vending machine of the present invention is a coin-operated, single-copy dispensing machine, which is easily manually adjustable to the thickness of the newspaper or periodical being dispensed.

In FIG. 1, the coin-operated, single-copy newspaper vending machine of this invention is designated generally by the reference numeral 10. Machine 10 includes a rectangular housing 12, having a front panel 14, right side panel 16, and left side panel 18, rear panel 19, and a forward and downward sloping, hinged, top loading panel 20. Top loading panel 20 is hinged to the rear panel 19, so that it may be raised vertically and rearward to load vending machine 10 with a supply of newspapers. The opening and closing of top panel 20 is controlled by a conventional key-lock mechanism 22. Top panel 20 incorporates a large transparent viewing panel 24, which enables the consumer to visually see the top copy of the periodical being dispensed, that being the copy he will purchase if he so desires. A second, smaller viewing panel 26, below the larger transparent viewing panel 24, permits the customer to view the process of his withdrawal of the single copy.

On the front panel 14, and to the right of the customer access door 34, is a commercially available coin-actuated release mechanism 28, with coin insertion means 29, with a coin return means 30, and a coin return slot 32 situated below. Following customer insertion of the proper combination of coins, the coin-actuated release mechanism 28, will then permit the unlatching of customer access door 34 by conventional means. The customer access door 34, has a handle 36, and is attached by a hinge 38 to front panel 14. By opening the customer access door 34 with the aid of the handle 36, the paper dispensing device 90 becomes visible. The paper dispensing device 90 will be fully described in reference to FIG. 4.

Figure 2:
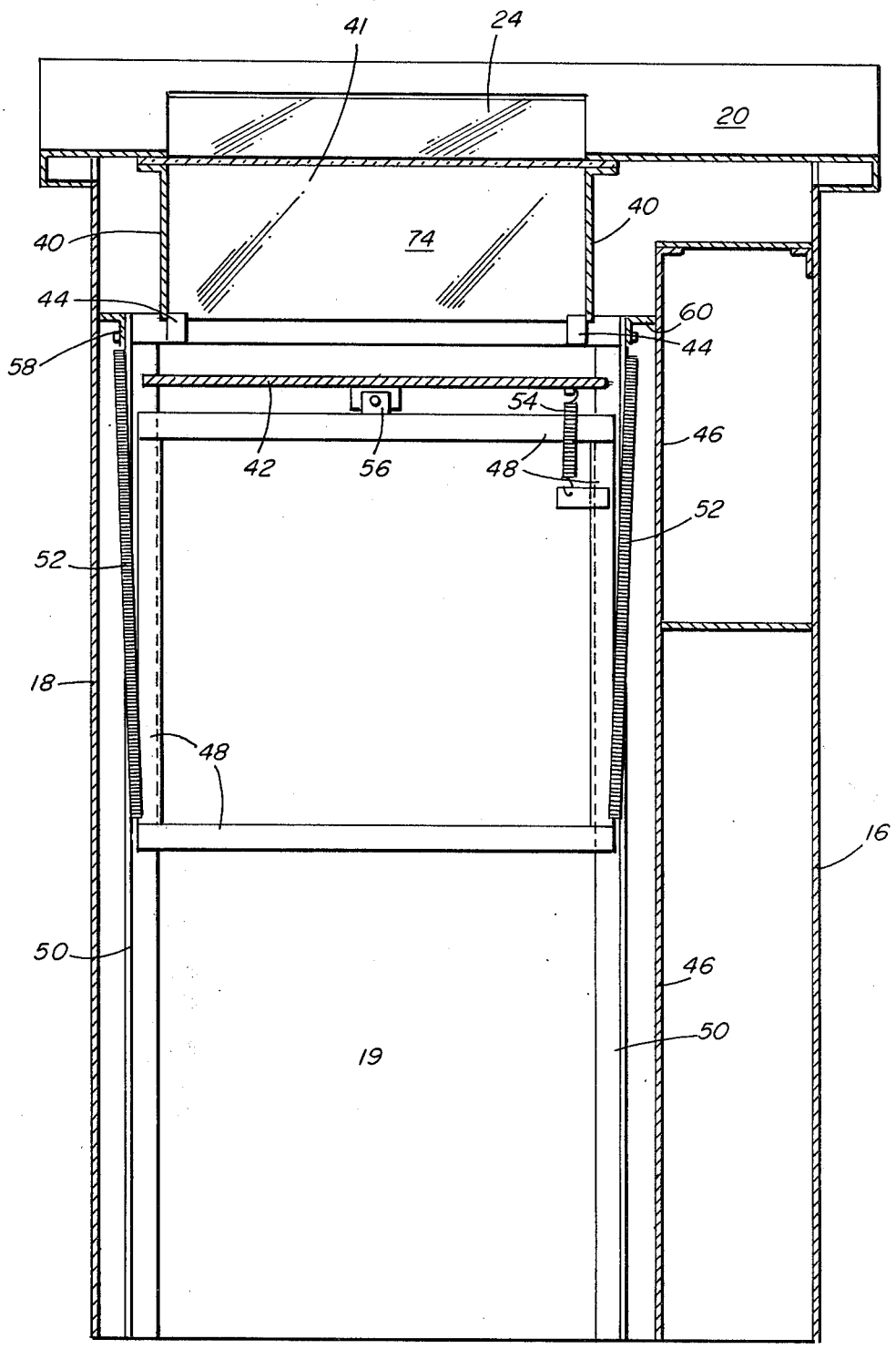
FIG. 2 is a cross-sectional view of the machine taken along the line 2—2 of FIG. 1.

FIG. 2 is a cross-sectional view of newspaper dispensing machine 10, showing the side panels of housing 40 of customer viewing chamber 41, the weight-activated newspaper supply platform 42, which is spring-loaded, and serves to bring the top newspaper of the enclosed stack up to the level of the withdrawal gate 96, of single-copy dispensing mechanism 90 as shown in FIG. 4, in contact with a pair of rollers 44, attached to the lower edges of the side panels of viewing housing 40. The rollers 44 function both to stop the upward travel of the stack of newspapers, as well as aid in the smooth withdrawal of the newspaper by the customer. The coin-actuated release mechanism 28 is situated in a space between the dividing panel 46 and the right side panel 16. The newspaper supply platform 42 is situated between the left side panel 18 and the dividing panel 46. The newspapers within machine 10 rest on supply platform 42, the underside of which is attached to its own box-like metal frame 48, which travels vertically, and is guided by four vertically-oriented right-angle irons 50. Newspaper platform 42 is controlled by four springs 52, such that the spring-loaded force is exerted on platform 42 in an upward direction to cause the upward movement of the supply platform 42. The left side pressure springs 52 are attached at their upper ends to the bracket for frame guide 58 mounted on left side panel 18. The two right side pressure springs 52, are attached at their upper ends to mounting brackets 60, affixed to the dividing panel 46. These four springs 52, are further attached at their bases to the lower side rods of the platform frame 48. A stabilizing spring 54 (FIG. 3) aids in leveling the newspapers being supplied. Brackets 56 attach the supply platform 42 to the supply platform frame 48.

Figure 3:
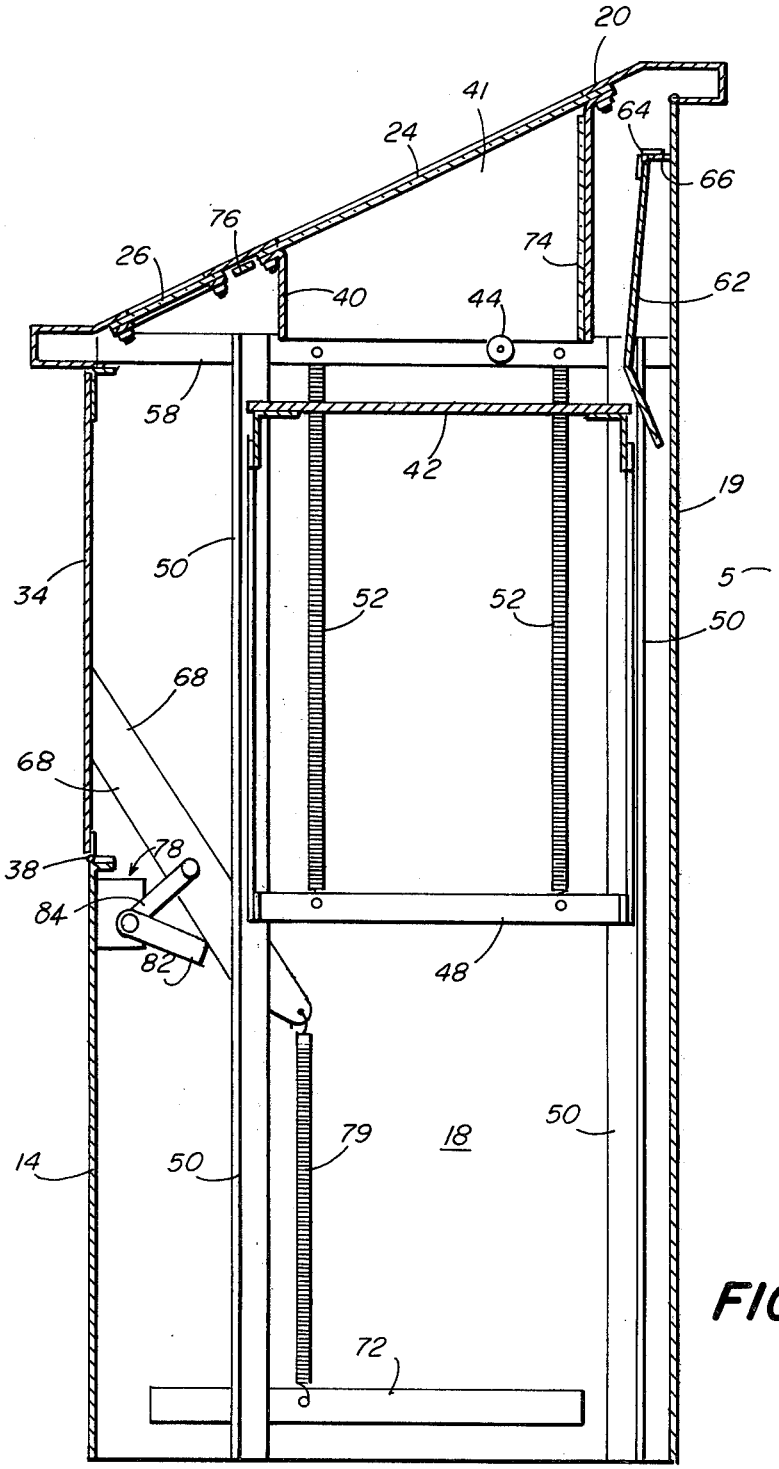
FIG. 3 is a cross-sectional view of the machine taken along the line 3—3 of FIG. 1.

FIG. 3 is a cross-sectional view of the machine taken along lines 3—3 of FIG. 1. It shows the newspaper supply platform 42, the relation between the supply platform frame 48, and its guiding mechanism of four right-angle irons 50, two of which are attached to the left side panel 18, and the remaining two right-angle irons 50 being attached to the dividing panel 46.

A vertical alignment panel 62 is mounted to the rear panel 19 by a hinge 64 that is attached to a lip 66 of the rear panel 19, that spatially orients the alignment panel 62 forward of the rear panel 19. The bottom of the alignment panel 62 is tapered backward to urge the newspapers forward as they approach the dispensing level. The customer access door 34 has an elongated rectangular bar 68 attached to its interior left bottom corner and which projects inwardly and downwardly at an acute angle, thereby enabling the forward edge to describe an arc as the customer access door 34 is opened and closed. Vertically oriented spring 79 is attached at its upper end to the lower tip of the bar 68, and at its lower end to a horizontally oriented bracket 72 mounted on the lower region of the left side panel 18. The travel downward of the extreme end of the bar 68 during closing of customer access door 34, results in the tripping of a release means 78, which then actuates lever 146 on the single copy dispenser mechanism 90. This will be further described in reference to FIG. 4.

Mirror 74 is attached to the viewing housing 40 rear surface, and the rollers 44 are attached one to each of the bases of the left and right side panels of the viewing housing 40. An articulated bar mechanism 76 is attached to the under surface of the top-loading panel 20, which serves as the key-controlled locking means 22 for the top loading panel 20. A release means 78 consisting of two projections 82 and 84, permanently mounted to each other at a right angle orientation, and rotatably mounted on a bracket 80, such that projections 82 and 84 may rotate through an arc of approximately 90°. When the customer-access door 34 is closed, the projecting bar 68 pushes projection 82 downward, and in so doing, causes projection 84 to move rearward, strike a lever 146 on means 90, as shown in FIG. 6, which then results in an unblocking of the single-copy dispensing mechanism withdrawal gate 96.

Figure 5:
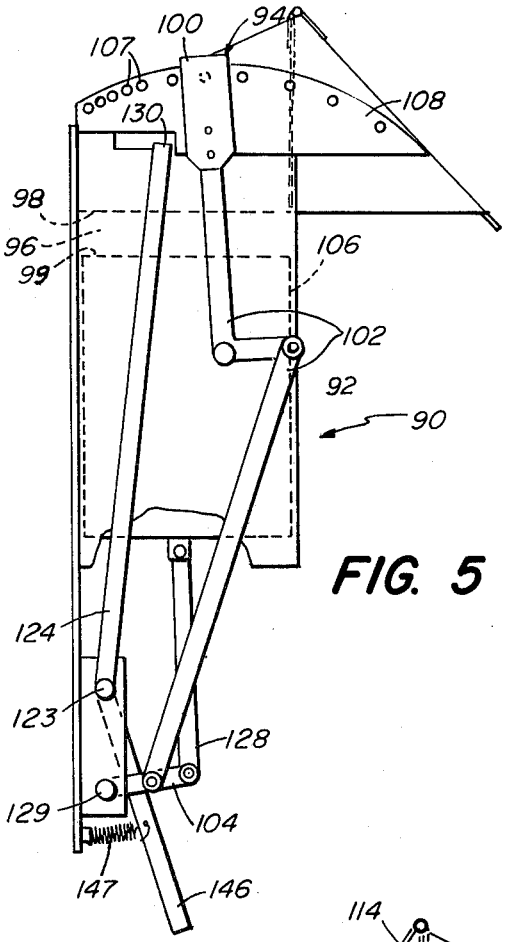
FIG. 5 is a side perspective view of the single-copy dispensing mechanism of the present invention.
Figure 7:
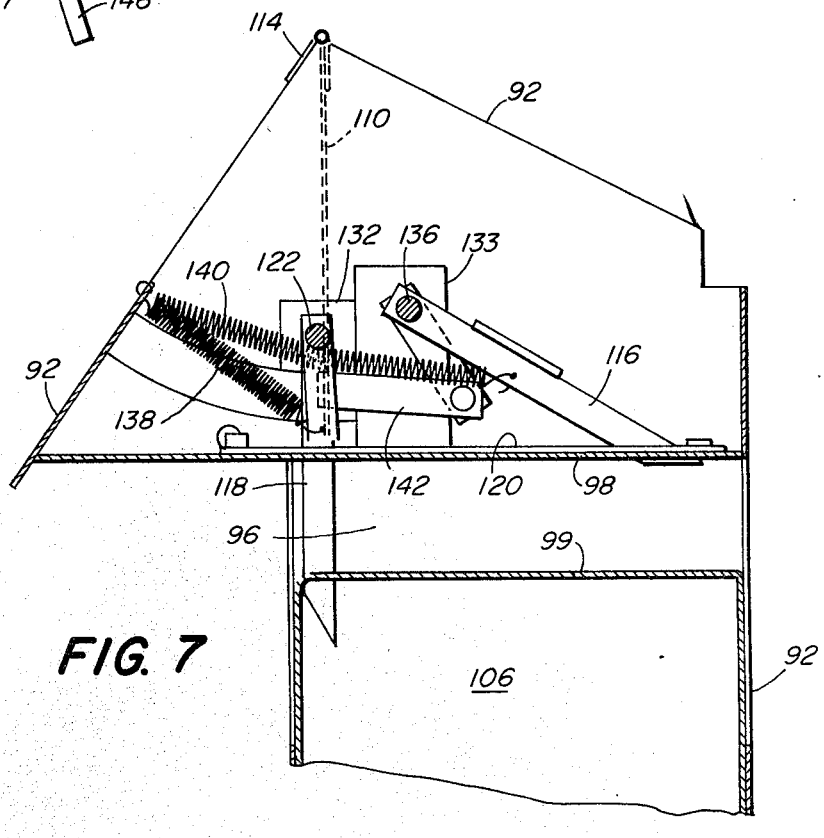
FIG. 7 is a cross-sectional view of the single-copy dispensing mechanism taken along line 7—7 of FIG. 4.

FIG. 4 is a front cut-away perspective view of the single-copy dispensing mechanism 90, showing portions of the paper thickness adjusting means 94 attached thereto. FIGS. 5, 6 and 7 are further detailed views of the single-copy dispensing means 90, and should be read in conjunction with FIG. 4. Dispensing mechanism 90 is positioned vertically, and situated behind customer access door 34, and forward of newspaper supply platform 42. Its basic housing 92, acts as part of the frame for the single-copy withdrawal gate 96. The withdrawal gate upper surface 98 is an inward extension of housing 92 and is stationary. The lower flat surface 99, of the withdrawal gate 96, which is also the upper surface of box 106, is positioned vertically by arcuate movement of the paper thickness adjusting means control lever 100, as shown in FIG. 5. Movement of the control lever 100 forward results in a narrowing of the opening of the withdrawal gate 96, while control lever 100 movement rearward results in a widening of the opening of the withdrawal gate 96. Control lever 100 is connected through an elongated articulated bar 102, whose lower attachment point 104, functions in conjunction with linkage 128, as a lever mechanism, which moves a slidable metal box 106 vertically, and in so doing, adjusts the size of the opening of the withdrawal gate 96. The paper thickness adjusting means control lever 100 travels backwards and forwards through an arc of 120°, and is click-stopped at a plurality of preadjusted positions, by means of setting grooves or holes 107, that are notched into the top convex edge of the control lever stop plate 108. Stop plate 108 is fixably mounted to the top of the right side of the single-copy dispensing mechanism housing 92. The vertically movable withdrawal gate box 106, upper surface 99, has a central depression 112, which enables the customer's hand to be placed underneath the top newspaper that is ready to be removed from the machine, once the customer access door 34 has been opened. This central depression also forms the lower portion of the viewing chamber 112.

Housing 92 forms the upper part of the frame for the viewing and access chamber 122, that allows both the viewing of the leading edge of the next available newspaper, as well as being a space for the forward and rearward arcuate travel of a vertically-mounted release plate 110, that is attached to the upper rear portion of the viewing chamber 112, by means of a hinge 114. As the top newspaper of the pile is being removed from the machine by the customer, the leading edge of this newspaper trips forward the unblocked sets of the then vertically-aligned levers 116 and 118, allowing the newspaper to be pulled through the single-copy withdrawal gate 96, and out of the machine without obstacles.

Referring now to FIGS. 6 and 7 we see that following this forward displacement of the sets of levers 116 and 118, levers 118 return to their original, rearward, vertically-oriented position, causing a spring-held, horizontally oriented plate 120 to move centrally. Plate 120 now temporarily blocks the further forward movement of levers 118, until a new cycle of both closing and then opening the customer access door 34 occurs.

Lever 118 is attached to horizontally oriented rod 122, which is rotatably mounted to the upper rear surface of dispensing means housing 92 by means of brackets 132. A stabilizing spring 134 is attached both to the rearmost end point on lever 120, and the upper rear surface of housing 92.

Horizontally oriented rod 123 is connected perpendicularly to a vertically oriented elongated bar 124, which has a right-angle projection 130, at its extreme upper end. Projection 130 of bar 124 serves as a temporary support for projection 126 which is mounted on rotatable rod 136. Rod 136 also serves as the attachment point for levers 116.

The forward travel of the newspaper being removed by the customer also results in levers 116 moving forward, with the rotation of rod 136, causing projection 126 to come to a temporary rest upon projection 130.

When the customer access door 34 is closed, projecting bar 68 strikes projection 82 which results in lever 84 of the releasing means 78, to rotatably travel upward, thereby striking lever 146 of the dispensing means 90, which through its connection to rod 123, and therethrough to bar 124, results in a forward movement of the upper right-angle projection 130, thereby allowing prljection 126 to rotate downward, and in so doing an extension plate on lever 116 pushes plates 120 outwards, so that levers 118 are now released and rotate forward.

Upon the next proper coin combination being fed into the coin-actuated release mechanism 28, the customer access door 34 is then unlocked, allowing the customer to pull the access door 34 forward and downward. A single copy of a newspaper now at the level of the withdrawal gate 96 can then be removed by the customer without obstacle. This completes the access door opening, customer removing paper, and access door closing, cycle of the machine.

I claim:

1. A coin-actuated, newspaper and periodical single-copy vending machine comprising:

a substantially rectangular housing having front, side, and rear panels; a hinged, forwardly-sloping, key-lock-controlled top panel serving as a newspaper loading door;

a customer viewing panel in said top-loading panel permitting the customer to view the top newspaper stored in said machine;

a vertically-oriented, substantially rectangular housing secured to the underside of said top-loading panel about the perimeter of said customer viewing panel, having a mirror on its rear panel to enlarge the customer viewing area;

a smaller, viewing panel in said top-loading panel permitting the customer to view his withdrawal of a newspaper from said machine;

a coin insertion and return mechanism on said front panel to control customer access to the newspapers within said machine;

a customer-access door hinged to said front panel to swing outwardly and downwardly, said access door having a handle for customer use;

said customer-access door being released upon insertion of a predetermined combination of coins in said coin insertion and return mechanism;

a spring-loaded newspaper supply platform having a stabilizing frame capable of vertical movement within said housing, to hold a supply of horizontally oriented newspapers and periodicals, and to raise the top newspaper in said supply to a dispensing mechanism;

said spring-loaded supply platform and frame travel being guided vertically by angle irons attached vertically to said cabinet housing;

a roller mounted at the base of each side panel of the customer viewing housing;

said rollers serving to stop the upward movement of newspapers on said spring-loaded supply platform, and also facilitating the sliding removal of the top newspaper therefrom;

a single-copy dispensing mechanism removably mounted in the front space of said cabinet vertically located between said customer access door and said spring-loaded supply platform;

said single-copy dispensing mechanism having a newspaper and periodical thickness control means;

said dispensing mechanism having a single-copy withdrawal means;

said dispensing means having a withdrawal gate access door which closes upon withdrawal of a newspaper from said dispensing mechanism; and said dispensing mechanism withdrawal gate being positioned such that it is coplanar with the topmost newspaper on said supply platform.

2. The apparatus of claim 1, wherein said single-copy dispensing mechanism further comprises:

a vertically oriented housing having a box-like structure with a front plate and a right and left side panel; said housing serving to support the periodical thickness control means and the single-copy withdrawal means;

a horizontally oriented, rectangular-shaped, opening through said housing serving as a withdrawal gate to permit the passage of the topmost newspaper from a stack of papers behind the withdrawal gate and out of the machine;

a vertically oriented, rectangular-shaped opening through said housing serving to allow the insertion of the customer's hand for the removal of the newspaper.

3. The apparatus of claim 1, wherein said thickness control means further comprises:

a box-like structure which is slidably mounted within the said dispensing mechanism housing, such that the top of said box-like structure moves vertically, and in so doing defines the opening of the withdrawal gate;

the base of the box-like structure of said means being connected through a series of articulated bars to a horizontally oriented rotatable rod; said rod being rotatably mounted to the rear of front panel of dispensing means housing; said rod being rotated through articulated bars being connected to a control lever;

said control lever being manually adjustable such that its movement describes an arc of 120°;

an arcuately-shaped control lever top plate being mounted on side of said single-copy dispensing means housing, which is notched to accept the control lever at various positions according to the thickness of the newspaper to be dispensed;

4. The apparatus of claim 1, wherein said single-copy withdrawal means further comprises a withdrawal gate access door which is fixably hinged to the top of the housing of the dispensing mechanism by means of a hinge;

a first set of levers, each mounted to a rotatable bar on each side of the upper central opening of the housing, said levers being connected through articulated rods to the withdrawal gate access door, such that the forward and upward movement of said levers closes said door and the downward and forward movement of said levers opens said door;

a projection on said rotatable bar which is raised to a latching position by the forward movement of the said first set of levers;

a latching assembly having two projections at right angles to eath other, rotatably mounted on front panel of said cabinet, and an inward and downward projecting bar secured to inside of said customer access door, such that said bar can engage the first of said projections on latching assembly.

* * * * *